US006884202B2

(12) United States Patent
Erwin

(10) Patent No.: US 6,884,202 B2
(45) Date of Patent: Apr. 26, 2005

(54) EXERCISE DEVICE

(76) Inventor: Stacy E. Erwin, 10308 Metcalf, Apt. 242, Overland Park, KS (US) 66212

( * ) Notice: Subject to any disclaimer, the term of this patent is extended or adjusted under 35 U.S.C. 154(b) by 364 days.

(21) Appl. No.: 10/231,795

(22) Filed: Aug. 29, 2002

(65) Prior Publication Data

US 2004/0043878 A1 Mar. 4, 2004

(51) Int. Cl.[7] ..... A63B 21/00
(52) U.S. Cl. ..... 482/124; 482/74; 482/121
(58) Field of Search ..... 482/111, 112, 482/105, 121, 124, 74, 122, 126, 125

(56) References Cited

U.S. PATENT DOCUMENTS

| | | | | |
|---|---|---|---|---|
| 2,224,103 A | | 12/1940 | Nilson | |
| 3,659,846 A | | 5/1972 | Kanicki | |
| 3,819,177 A | | 6/1974 | Spiro | |
| 4,815,731 A | * | 3/1989 | Suarez et al. | 482/124 |
| 5,490,826 A | * | 2/1996 | Rose | 482/74 |
| 5,573,487 A | | 11/1996 | Wallner | |
| 5,591,089 A | * | 1/1997 | Huffines | 473/215 |
| 5,683,336 A | * | 11/1997 | Pape | 482/124 |
| 5,711,747 A | | 1/1998 | Steinback | |
| 5,807,218 A | | 9/1998 | Nagatomo | |
| 5,836,857 A | | 11/1998 | Jennings | |

* cited by examiner

*Primary Examiner*—Jerome W. Donnelly
(74) *Attorney, Agent, or Firm*—Chase Law Firm, L.C.

(57) ABSTRACT

A training device includes a pair of limb encircling cuffs with an elastic band therebetween. On each cuff is a buckle for releasably attaching one end of the tension band thereto. Each buckle includes a frame with a slidable latch therein, the latch having a locking post movable between a first seated and a second unseated position. A ring fastener at the end of the band encircles the seat such that movement of the post to its seated position extends the post through the ring. Movement of the post to the seated position is provided by expansion of a spring as previously compressed by the unseated latch.

14 Claims, 2 Drawing Sheets

EXERCISE DEVICE

BACKGROUND OF THE INVENTION

This invention relates to exercise equipment and, more particularly, to an improved strengthening device utilizing a pair of limb encircling cuffs with an elastic member releasably extensible therebetween.

Devices which offer an isometric-type of resistance to exercise the leg and hip muscles of the body and strengthen the same are desirable. Past devices have included a rubber band which extends between a pair of leg encircling straps so that movement of the legs will be resisted by this intermediate elastic band. The elastic band provides dynamic resistance to the opposing movement of the legs. It is desirable to vary the resistance of this elastic band. Thus, such devices should provide for easy release and connection of an elastic band from a selectable plurality of elastic bands so as to easily vary the level of dynamic resistance.

In response thereto I have invented an exercise device which enhances muscular and cardiovascular conditioning by creating resistance to leg or other limb movement. My device helps improve speed, agility and flexibility while strengthening the cardiovascular system and can be utilized in exercise, walking or running modes.

My exercise device includes a pair of cuffs/straps which are adapted to fit about the opposing limbs, e.g., the left and right legs of the user. Extending between the strap is a Neoprene® elastic band having ring fasteners at the end thereof. A specially designed buckle, positioned on each strap, allows for a quick, releasable engagement of the end of a selectable elastic band to the respective cuffs. Upon closure the buckle structure ensures that the band will stay in place and continue rotation during exercise. The use of my particularly designed buckle allows for an elastic band to be selected from a plurality of bands and easily attached in extension between the cuffs so as to vary the offered resistance.

It is therefore a general object of this invention to provide an exercise device which enhances the physical conditioning of the user.

Another object of this invention is to provide a device, as aforesaid, which includes a pair of cuffs with buckles thereon, the buckles providing for quick engagement and/or release of a tension band of various resistances thereto.

A further object of this invention is to provide a device, as aforesaid, wherein the aforesaid buckle is easily operable by the user.

A still further object of this invention is to provide a device with buckle, as aforesaid, wherein the buckle includes a frame with a spring biased tongue slidable between locking and release positions.

Another particular object of this invention is to provide a buckle, as aforesaid, which provides a locking post acting as a pivot pin for a ring fastener therearound.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 7:
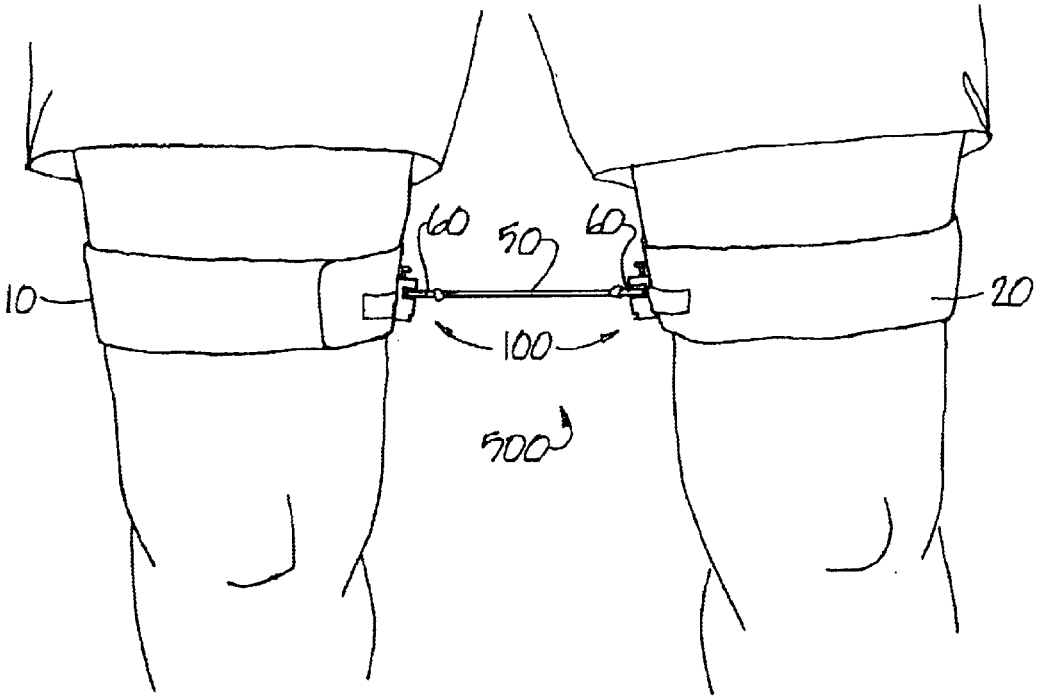
FIG. 7 shows one use of the exercise device about the legs of a user.

Turning more particularly to the drawings, FIG. 7 shows my exercise device 500 as comprising first and second cuffs/straps 10, 20 with an elastic band 50 releasably connected to my novel buckle 100 on each cuff. Each cuff has complementary Velcro® fastener elements 30, 40 at the opposed ends thereof so that the cuffs can be easily secured about the limbs of users having various body sizes. For purposes of illustration and not limitation, the device is illustrated as attached to the legs of the user as shown in FIG. 7.

The Neoprene® tension band 50 is of a preselectable resistance with each tension band having a circular ring fastener 60 at the opposed ends thereof. The ring fastener 60 is designed to be releasably engageable with the buckle 100, as secured by strap 12, in rotatable movement about a locking post 260 as to be subsequently described.

The buckle member 100, as attached to the end of each strap 10, 20, comprises a frame 110 with a slidable tongue/latch 200 therein. Frame 110 has upper 116 and lower 118 walls with a first pair of laterally spaced-apart sidewalls 120, 122 extending therebetween. A second pair of walls 124, 126 extends between walls 116, 118 at the ends thereof. Extending between walls 120, 122 is an intermediate wall 131. A cover 130 with slots therein 133 extends between walls 120, 122 and 118, 131 for forming a spring chamber 125.

A slidable latch member 200 in the form of a tongue includes first 210 and second 212 arms presenting free edges. These edges seat within tracks formed by flanges 140, 142 extending along the underside of walls 120, 122 via interconnecting webs. Thus, a slot is formed between the walls 120, 122 and spaced flanges 140, 142 for receiving the free edges of arms 210, 212 therein. Slots 150, 151 within wall 116 act as guides for arms 210, 212. Similar slots are found in the intermediate wall 131.

Figure 1:
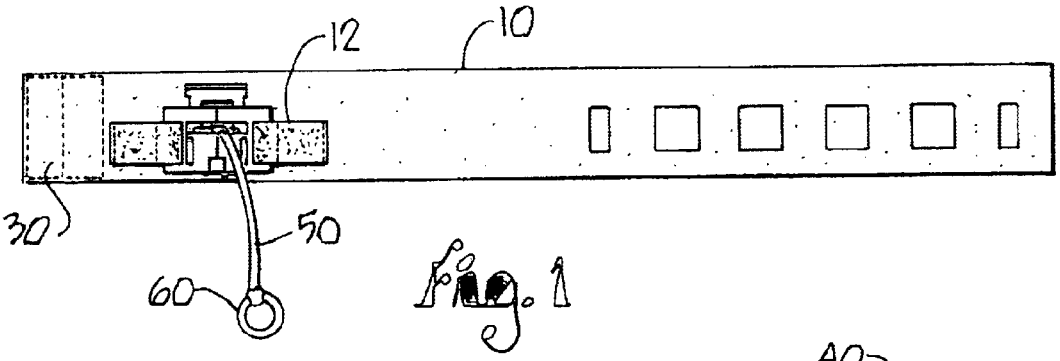
FIG. 1 is a front plan view of a limb encircling cuff with a buckle thereon at one end thereof with an elastic band fastened to the buckle.
Figure 2:
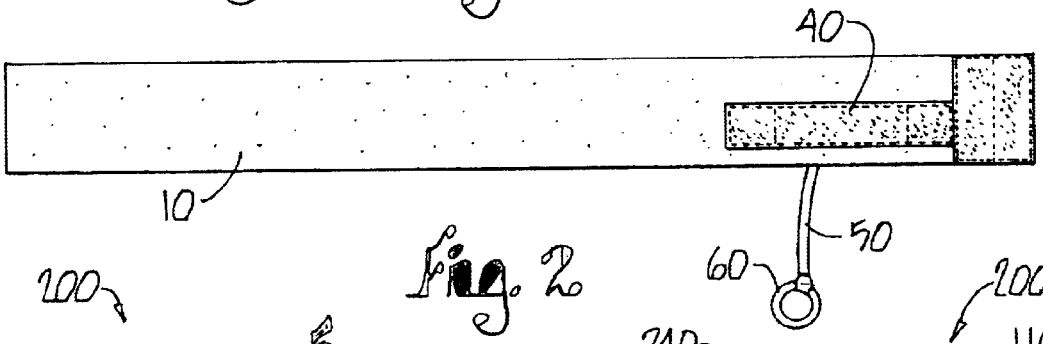
FIG. 2 is a rear view of the FIG. 1 cuff.
Figure 3:
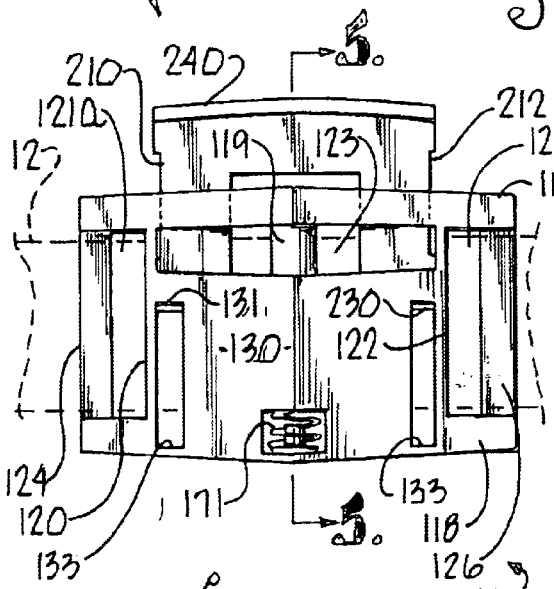
FIG. 3 is an enlarged view of the buckle in a locking position.
Figure 4:
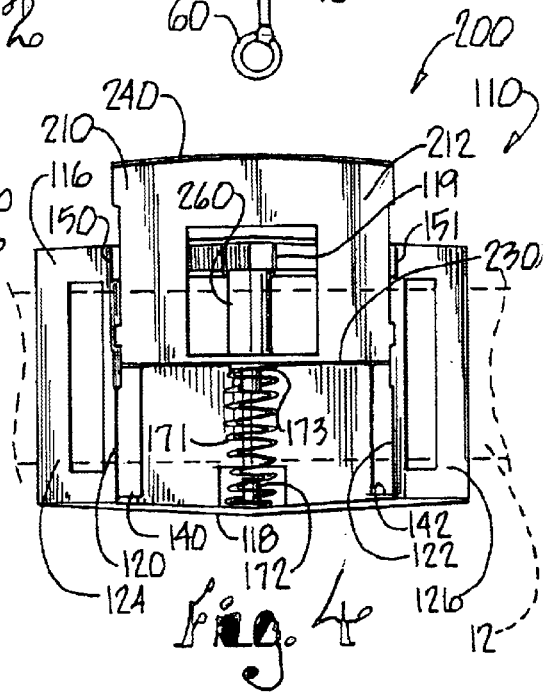
FIG. 4 is a plan view of the FIG. 4 buckle with the frame housing broken away to show the interior thereof.
Figure 5:
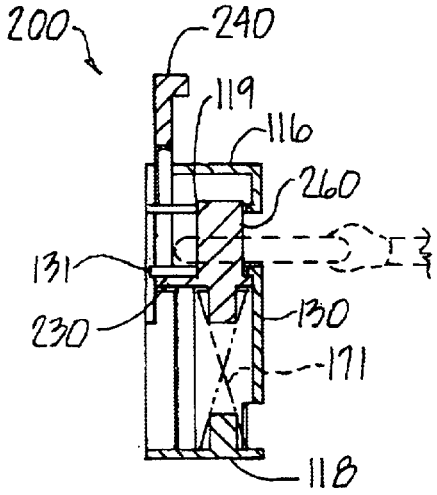
FIG. 5 is a sectional view, taken along line 5—5 in FIG. 3, with the ring fastener of the elastic band in place about the locking post as shown in phantom lines.
Figure 6:
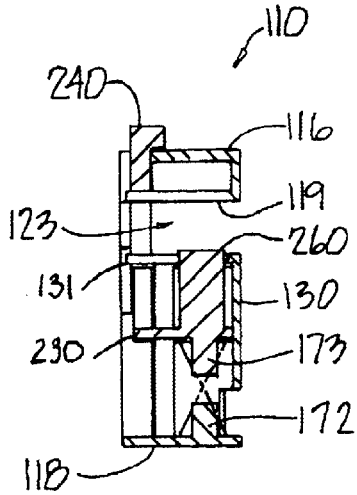
FIG. 6 is a sectional view, as in FIG. 5, showing the buckle in an open/release position.

Tongue 200 includes a lower wall 230 with lug 173. One end of a spring 171 encircles lug 173 with the other end about a lug 172 connected to lower wall 118. Lugs aid in precluding buckling of the spring 171 during compression. A portion of cover 130 and wall 116 has been broken away in FIG. 4 to show spring 171 and the seating of arms 210, 212 within the track. As such expansion of the spring 171 urges the tongue along the tracks in a first direction (upwardly as viewed) in which the top wall 240 of the tongue 200 is displaced beyond the top wall 116 of frame 110. This top wall 240 presents a purchase surface for the thumb of the user.

Further extending from the lower tongue wall 230 is a locking post 260 which extends through an aperture in the intermediate wall 113. The end of the post 260 is adapted to seat within an aperture 119 in the top wall 116 of frame 110.

As the spring 171 normally extends, the spring 171 directs the locking post 260 into engagement with the seat aperture 119.

To displace locking post 260 from the seat 119 the user urges the top wall 240 of tongue 200 towards the bottom wall 118 of frame 110 which compresses the spring 171. During such movement, the free edges of the tongue arms 210, 212 move along the above-described tracks. This movement displaces the post 260 from its seat 119 and its extension across the slot 123 between the intermediate wall 113 and the upper wall 116 of the frame 110. At this position the ring fastener 60 is inserted within slot 123 and about the seat 119. Upon release of the tongue 200, the expanding spring 171 urges the post 260 into seat 119 and in extension through the ring 60. At this position, the ring 60 is freely rotatable about the seated post 260. Thus, one end of the elastic band 50 is freely rotatable about post 260 and the adjacent cuff 10, 20. This procedure is repeated for the opposed end of the elastic band such that the elastic band is connected to the buckle 100 on the other cuff.

The configuration of the buckle displaces the locking post 260 and ring 60 away from the underlying cuff 10, 20 which encircles the limb of the user. This ring displacement precludes any undesirable friction between the rotating ring 60 and underlying cuff and thus the limb of the user. Furthermore, the intermediate strap 12, which is attached to each cuff and extends through the slots 121*a*, 121*b* of the buckle 100, further protects against such an undesirable friction. Thus, during exercise any irritable rubbing of the ring 60 on the limb of the user is precluded.

Accordingly, my above-described device enables the intermediate tension band 50 to be easily attached to the buckles 100 found on each cuff 10, 20. The positive action of the locking post 260 assures the user that such band 50 will remain secured during use.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. In an exercise device presenting a pair of cuffs adapted for encircling a selected limb of a user's body and a resistance band extending between the cuffs, the improvement comprising a device for releasable attachment of an end of the resistance band to one of the cuffs, said device comprising:

a frame for attachment to the cuff, said frame including spaced-apart first and second walls;

at least one track in said frame extending between said first and second walls;

a spring having first and second ends, said first end attached to said first wall of said frame;

a seat in said second wall of said frame;

a latch having first and second walls with at least one wall extending therebetween, said at least one wall in said latch adapted for slidable movement along said at least one track in said frame;

a post extending from said first latch wall, said post adapted for seating within said frame seat;

said second end of said spring bearing against said latch, an expansion of said spring sliding said latch in a first direction wherein said post is in said frame seat;

a slidable movement of said latch along said at least one track moving said latch in a second direction displacing said post from said seat and compressing said spring;

a fastener at an end of the band, said fastener positioned about said seat upon said displacing of said post from said aperture, an expansion of said spring urging said latch into said first direction and said post through said fastener and into said seat, whereby to connect said respective end of said band about said post.

2. The device as claimed in claim 1 wherein said at least one wall extending between said first and second walls of said latch comprises first and second parallel tracks extending between said first and second latch walls.

3. The device as claimed in claim 1 wherein one of said first or second walls of said latch is exterior of said frame, an urging of said one of said latch walls towards said frame sliding said latch in said second direction and compressing said spring.

4. The device as claimed in claim 1 further comprising a cover atop said spring.

5. The device as claimed in claim 1 further comprising means for attaching said device to one of the cuffs.

6. The device as claimed in claim 1 further comprising a third frame wall intermediate said first and second frame walls, at least one of said frame walls including at least one notch therein, said at least one notch guiding said at least one latch wall during said slidable movement.

7. The device as claimed in claim 6 wherein said intermediate wall includes an aperture therein for extension of said post therethrough, said intermediate wall aperture guiding said post during said movement of said latch in said first and second directions.

8. The device as claimed in claim 1 wherein said second end of said spring bears against one of said first or second latch walls.

9. The device as claimed in claim 1 further comprising:

a first lug extending from said frame first wall, said first end of said spring about said first lug;

a second lug extending from said latch, said second end of said spring about said second lug, said lugs maintaining said spring in place during said extension and compressing of said spring.

10. For use with an exercise device presenting a pair of cuffs adapted for encircling selected limbs of a user's body and a resistance band extending between the cuffs, the improvement comprising a buckle on each cuff for releasable attachment of an end of the resistance band thereto, each said buckle comprising:

a frame for attachment to the cuff;

a tongue within said frame and movable between a first normal and a second position relative to said frame;

means in said frame for defining a course of movement for said tongue between said normal first position and said second position;

means in said frame for urging said tongue into said first normal position;

a seat in said frame;

a post on said tongue, said post in said seat at said first normal position and free of said seat at said second position;

a fastener at an end of the band, each fastener configured for extension of said post therethrough at said tongue first normal position, a movement of said tongue from said normal position to said second position displacing said post from said fastener, whereby to release the end of the band from said buckle.

11. The device as claimed in claim 10 wherein said urging means comprises a spring, a movement of said tongue to said second position compressing said spring, an expansion of said compressed spring urging said tongue to said first normal position.

12. The device as claimed in claim 11 further comprising means for maintaining said spring in position during said compression of said spring.

13. The device as claimed in claim 10 wherein said defining means comprises a track adapted for receiving a portion of said tongue therein, said track extending along said desired course of movement for said tongue.

14. The device as claimed in claim 10 further comprising means for attaching said device to the cuff.

* * * * *